US005525927A

United States Patent [19]

Yung et al.

[11] Patent Number: 5,525,927

[45] Date of Patent: Jun. 11, 1996

[54] MOS CURRENT MIRROR CAPABLE OF OPERATING IN THE TRIODE REGION WITH MINIMUM OUTPUT DRAIN-TO SOURCE VOLTAGE

[75] Inventors: Henry T.-H. Yung, Richardson; Steve W. Yang; James R. Hellums, both of Plano, all of Tex.

[73] Assignee: Texas Instruments Incorporated, Dallas, Tex.

[21] Appl. No.: 384,078

[22] Filed: Feb. 6, 1995

[51] Int. Cl.[6] ..... G05F 3/26

[52] U.S. Cl. ..... 327/543; 327/541; 327/538; 327/546; 323/315; 323/316

[58] Field of Search ..... 327/538, 540, 327/541, 543, 546, 545; 323/313, 315, 316

[56] References Cited

U.S. PATENT DOCUMENTS

| | | | |
|---|---|---|---|
| 4,495,425 | 1/1985 | McKenzie | 327/541 |
| 4,703,249 | 10/1987 | De La Plaza et al. | 323/316 |
| 5,087,891 | 2/1992 | Cytera | 327/537 |
| 5,155,394 | 10/1992 | Szepesi | 327/542 |
| 5,164,658 | 11/1992 | Kuwahara | 327/541 |
| 5,304,861 | 4/1994 | Fruhauf et al. | 327/514 |

*Primary Examiner*—Terry Cunningham

*Attorney, Agent, or Firm*—Alan K. Stewart; Richard L. Donaldson; William E. Hiller

[57] ABSTRACT

A circuit includes a first transistor $M_1$; a second transistor $M_2$ having a gate coupled to a gate of the first transistor $M_1$ and a source coupled to a source of the first transistor $M_1$; a third transistor $M_3$ having a source coupled to a drain of the first transistor $M_1$ and a drain coupled to a current input $I_b$, the drain of the third transistor $M_3$ is coupled to the gate of the first transistor $M_1$; a fourth transistor $M_4$ having a source coupled to a drain of the second transistor $M_2$, a gate coupled to a gate of the third transistor $M_3$, and a drain coupled to a supply node $V_{DD}$; and a variable voltage input $V_x$ coupled to the gate of the third transistor $M_3$.

4 Claims, 1 Drawing Sheet

MOS CURRENT MIRROR CAPABLE OF OPERATING IN THE TRIODE REGION WITH MINIMUM OUTPUT DRAIN-TO SOURCE VOLTAGE

FIELD OF THE INVENTION

This invention generally relates to electronic systems and in particular it relates to MOS current mirrors.

BACKGROUND OF THE INVENTION

A current mirror is a current-controlled current source wherein the current output is proportional to the current input. A basic MOS transistor current mirror includes two MOS transistors having the same gate-to-source voltage. With both transistors operating in the saturation region, and the gate and drain of the first transistor coupled together, the current through the second transistor will be approximately proportional to the current through the first transistor independent of the drain-to-source voltage on each transistor. However, when the second transistor is operating in the triode region (low drain-to-source voltage), the basic MOS transistor current mirror breaks down because the current is no longer independent of drain-to-source voltage.

SUMMARY OF THE INVENTION

Generally, and in one form of the invention, the current mirror circuit includes a first transistor; a second transistor having a gate coupled to a gate of the first transistor; and a third transistor having a source coupled to the drain of the first transistor and a drain coupled to the gate of the first transistor such that a constant ratio is maintained between a current flowing through a drain-source path of the first transistor and a current flowing through a drain-source path of the second transistor even when the second transistor is operating in a triode region.

DETAILED DESCRIPTION OF PREFERRED EMBODIMENTS

Figure 1:
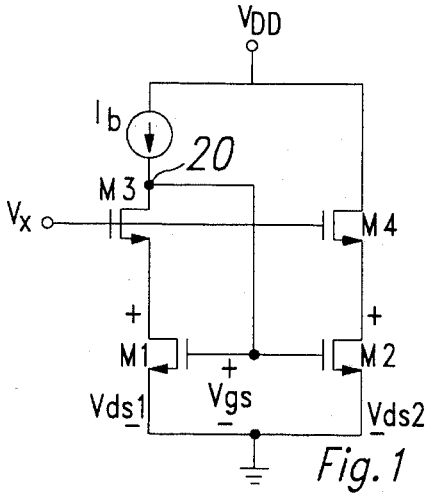
FIG. 1 is a schematic diagram of the preferred embodiment current mirror circuit.

Referring to FIG. 1, a circuit diagram of a preferred embodiment current mirror is shown. The circuit includes MOSFET's $M_1$–$M_4$, variable voltage $V_x$, current input $I_b$, voltage $V_{ds1}$, voltage $V_{ds2}$, and supply voltage $V_{DD}$. In this embodiment, transistors $M_1$, $M_2$, $M_3$, and $M_4$ are n-channel transistors. Transistors $M_1$ and $M_2$ are controlled by the voltage at node 20. Transistors $M_3$ and $M_4$ each are controlled by variable voltage $V_x$.

In the preferred embodiment current mirror circuit, shown in FIG. 1, three states of operation are possible when $M_1$ equals $M_2$ and $M_3$ equals $M_4$. These three states of operation depend on $V_x$. In the first state, $M_1$, $M_2$, $M_3$, and $M_4$ are all in the saturation region. This is basically a cascode current mirror. The drain-to-source voltage $V_{ds1}$ of $M_1$ and $V_{ds2}$ of $M_2$ are about the same. In the second state, $M_1$, $M_2$, and $M_4$ are in the saturation region, but $M_3$ is in the triode region. This will happen when $V_x$ is raised high enough. $V_{ds1}$ will be different from $V_{ds2}$, but $M_1$ and $M_2$ will act as a simple current mirror because they are in the saturation region. In the third state, $M_1$ and $M_2$ are in the triode region, but $M_3$ and $M_4$ are in the saturation region. This is the region of interest when $V_x$ is relatively low. Since $M_1$ and $M_2$ are in the triode region, they could lose their effectiveness as a current mirror. However, since $M_3$ and $M_4$ are in the saturation region, and $M_1$ and $M_2$ share the same gate-to-source voltage $V_{gs}$, $V_{ds1}$ will be approximately equal to $V_{ds2}$. Therefore, the currents through $M_1$ and $M_2$ will be about the same. When $V_{ds1}$ is reduced, $V_{gs}$ will increase so as to maintain a current of $I_b$ through $M_1$, and when $V_{ds1}$ is increased, $V_{gs}$ will decrease. Therefore, it is possible for this current mirror to stay effective even with very small $V_{ds1}$ and $V_{ds2}$.

The preferred embodiment current mirror will normally be stable in all 3 states of operation without having to add a compensation capacitor. Therefore, the bandwidth can be relatively high. Since $M_1$ and $M_2$ can be in the triode region and still mirror current effectively, their width-to-length ratios can often be reduced, resulting in smaller sizes. Because of the simplicity of this current mirror, it can be easily applied in various circuits. It is especially useful in low supply voltage designs. The invention is equally applicable to p-channel current mirrors. There are many possible applications of this current mirror.

Figure 2:
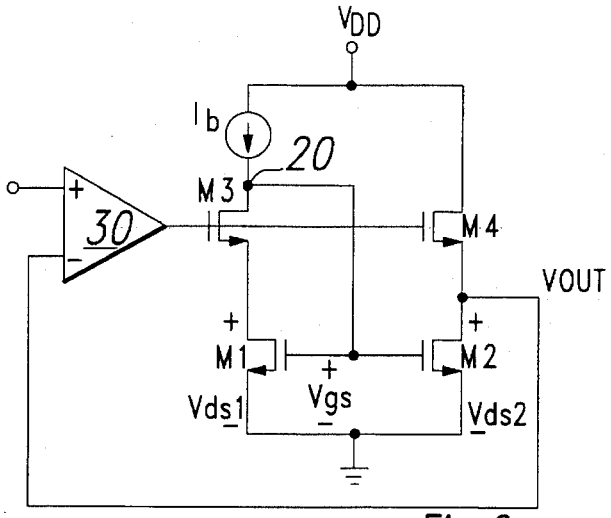
FIG. 2 is a schematic diagram of an outbut source follower of an op amp using the preferred embodiment of FIG. 1.

One application of the preferred embodiment of FIG. 1 is an output source follower of an op amp, as shown in FIG. 2. The circuit of FIG. 2 includes op amp 30, the circuit of FIG. 1, and output voltage $V_{out}$. When the current mirror is used as an output source follower of an op amp, as shown in FIG. 2, the output voltage $V_{out}$ is able to get very close to ground without losing the gain and bandwidth of the op amp. The transistor $M_2$ basically behaves as a good constant current source even when $V_{out}$ is very small.

Figure 3:
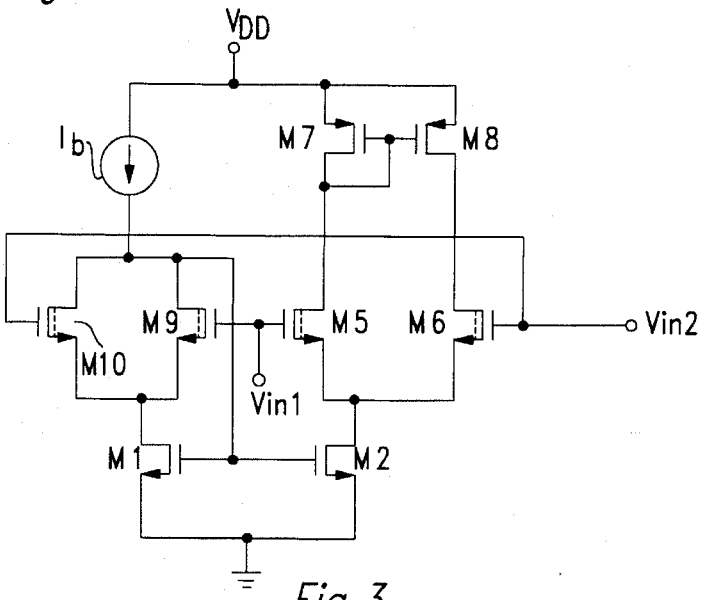
FIG. 3 is a schematic diagram of a tail current-source for a differential input pair of an op amp using the preferred embodiment of FIG. 1.

Another application of the preferred embodiment of FIG. 1 is a tail current source for a differential input pair of an op amp, as shown in FIG. 3. The circuit of FIG. 3 includes transistors $M_1$, $M_2$, $M_5$, $M_6$, $M_7$, $M_8$, $M_9$, and $M_{10}$, current input $I_b$, and input voltages to the differential input pair $V_{in1}$ and $V_{in2}$. Transistors $M_5$ and $M_6$ replace transistor $M_4$ of FIG. 1. Transistors $M_9$ and $M_{10}$ replace transistor $M_3$ of FIG. 1.

When the preferred embodiment current mirror is used as a tail current source for the differential input pair of an op amp, as shown in FIG. 3, the input pair $M_5$ and $M_6$ can swing a lot closer to ground since $M_2$ will remain as an effective current source. This increases the common mode input range of the op amp. In FIG. 3, transistors $M_5$, $M_6$, $M_9$, and $M_{10}$ are shown as low $V_t$ transistors. This is often desirable to allow the op amp input to get closer to ground.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A circuit comprising:

a first transistor;

a second transistor having a gate coupled to a gate of the first transistor and a source coupled to a source of the first transistor and ground;

a current input;

a third transistor having a source coupled to the drain of the first transistor and a drain coupled to the current input, the drain of the third transistor is coupled to the gate of the first transistor;

a fourth transistor having a source coupled to a drain of the second transistor, a gate coupled to a gate of the third transistor;

a first variable voltage input coupled to the gate of the third transistor;

a fifth transistor having a drain-source path coupled in parallel with a drain-source path of the third transistor;

a sixth transistor having a source coupled to the drain of the second transistor and having a gate coupled to the gate of the fifth transistor;

a second variable voltage input coupled to the gate of the fifth transistor;

a seventh transistor having a drain and a gate coupled to a drain of the fourth transistor, and a source coupled to a supply node; and an eighth transistor having a drain coupled to a drain of the sixth transistor, a gate coupled to the gate of the seventh transistor, and a source coupled to a source of the seventh transistor.

2. A circuit comprising:

a first transistor;

a second transistor having a gate coupled to a gate of the first transistor and a source coupled to a source of the first transistor and ground;

a third transistor having a source coupled to a drain of the first transistor and a drain coupled to a current input, the drain of the third transistor is coupled to the gate of the first transistor;

a fourth transistor having a source coupled to a drain of the second transistor, a gate coupled to a gate of the third transistor, and a drain coupled to a supply node; and a variable voltage input coupled to the gate of the third transistor.

3. The circuit of claim 2 wherein the variable voltage input is an output of an op amp, an input of the op amp is coupled to the source of the fourth transistor.

4. The circuit of claim 2 wherein the transistors are N-channel transistors.

* * * * *